US008720798B2

(12) United States Patent
Lynn

(10) Patent No.: US 8,720,798 B2
(45) Date of Patent: May 13, 2014

(54) DRYWALL SPRAY GUN

(76) Inventor: Rick Lynn, Farmington, MO (US)

( * ) Notice: Subject to any disclaimer, the term of this patent is extended or adjusted under 35 U.S.C. 154(b) by 314 days.

(21) Appl. No.: 13/326,324

(22) Filed: Dec. 15, 2011

(65) Prior Publication Data

US 2013/0153679 A1 Jun. 20, 2013

(51) Int. Cl.
*B05B 9/01* (2006.01)
*B05B 9/00* (2006.01)

(52) U.S. Cl.
USPC ..... 239/379; 239/128; 239/375; 239/376; 239/526; 222/146.6; 222/333

(58) Field of Classification Search
USPC ..... 239/128, 302, 345, 375–377, 379, 239/390–392, 525, 526; 222/146.6, 222/323–325, 333, 372, 465.1, 566
See application file for complete search history.

(56) References Cited

U.S. PATENT DOCUMENTS 2,887,274 A * 5/1959 Swenson ..... 239/371
2,964,302 A * 12/1960 Tombu ..... 366/11
3,236,459 A * 2/1966 McRitchie ..... 239/416
4,863,104 A * 9/1989 Masterson ..... 239/345
5,119,993 A * 6/1992 Gunzel et al. ..... 239/654
5,232,161 A * 8/1993 Clemmons ..... 239/346
5,255,846 A * 10/1993 Ortega ..... 239/103
5,415,351 A * 5/1995 Otto et al. ..... 239/345
5,727,736 A * 3/1998 Tryon ..... 239/345
6,726,125 B1 * 4/2004 Nonis et al. ..... 239/375
2004/0129802 A1 * 7/2004 Bell, Sr. ..... 239/379
2004/0182042 A1 * 9/2004 vonBampus ..... 52/742.13
2004/0182974 A1 * 9/2004 Welland et al. ..... 248/146
2007/0252019 A1 * 11/2007 Peterson et al. ..... 239/337
2007/0261913 A1 * 11/2007 Rossner et al. ..... 181/212
2011/0297754 A1 * 12/2011 Valdez ..... 239/8

* cited by examiner

*Primary Examiner* — Darren W Gorman
(74) *Attorney, Agent, or Firm* — Michael Ries

(57) ABSTRACT

The present invention is a drywall spray gun that disperses drywall material that includes a funnel-shaped hopper, a casing that houses a flip lever and a fan, a slide lock trigger and a trigger shield that protects the slide lock trigger from being struck or touched unintentionally and a rechargeable battery pack. The spray gun also includes a removable motor, a forearm rest, an adjustable nozzle and a corresponding stand with a bottom base, an upright vertical backing and a c-shaped top that secures the drywall spray gun in place while the drywall material is poured into the hopper.

20 Claims, 3 Drawing Sheets

DRYWALL SPRAY GUN

TECHNICAL FIELD & BACKGROUND

The present invention generally relates to a drywall spray gun. More specifically, the invention is a rechargeable drywall spray gun.

It is an object of the invention to provide a drywall spray gun that saves time and money compared to a traditional drywall spray gun.

It is an object of the invention to provide a drywall spray gun that operates in an environment such as a home under construction that does not have electrical power.

It is an object of the invention to provide a drywall spray gun that includes a corresponding stand to securely pour drywall material into the drywall spray gun.

What is really needed is a drywall spray gun that saves time and money compared to a traditional drywall spray gun that operates in an environment such as a home under construction that does not have electrical power that includes a corresponding stand to securely pour drywall material into the drywall spray gun.

BRIEF DESCRIPTION OF THE DRAWINGS

The present invention will be described by way of exemplary embodiments, but not limitations, illustrated in the accompanying drawing in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
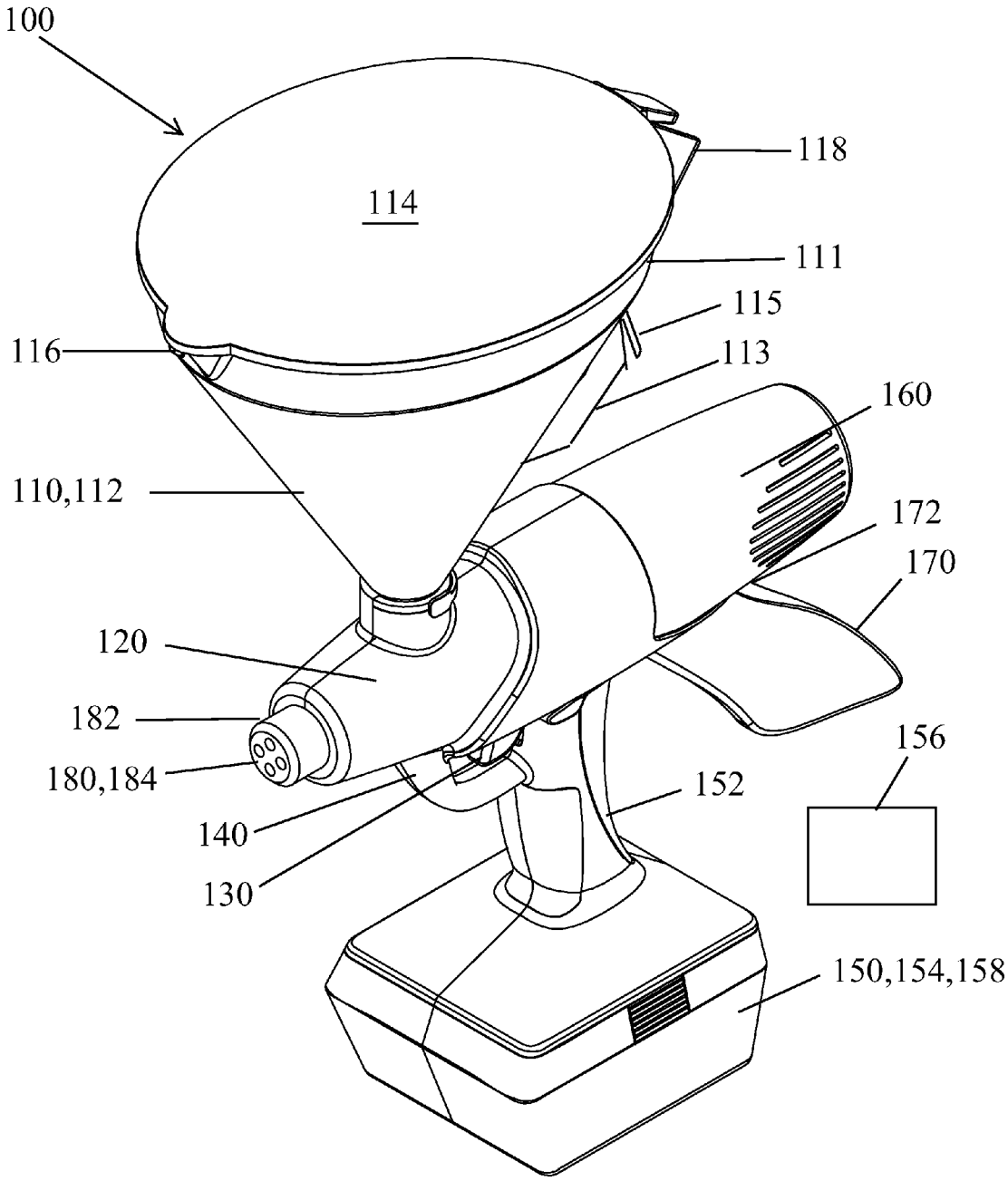
FIG. 1A illustrates a diagonal front side perspective view of a drywall spray gun, in accordance with one embodiment of the present invention.

FIG. 1A illustrates a diagonal front side perspective view of a drywall spray gun 100, in accordance with one embodiment of the present invention.

The drywall spray gun 100 includes a hopper 110, a casing 120, a slide lock trigger 130, a trigger shield 140, a rechargeable battery pack 150, a removable motor 160, a forearm rest 170 and an adjustable nozzle 180. The hopper 110 is funnel-shaped 112 although the hopper 110 can be other suitable shapes as well. The hopper 110 includes a lid lock 114 that covers the hopper 110 after any suitable drywall material to be dispersed is poured into the hopper 110. The hopper 110 has an approximate 2.0 gallon capacity and is made of plastic, metal or other suitable material. The hopper 110 has a rounded pouring edge 116 and a triangular-shaped pouring edge 118 to pour any drywall material out of the hopper 110 if needed. The rounded pouring edge 116 and the triangular-shaped pouring edge 118 are positioned 180 degrees across from each other along the top perimeter 111 of the hopper 110. The hopper 110 also has a handle 113 and an ergonomic tab 115 to grasp and maneuver the hopper 110 as desired.

The casing 120 houses a plurality of internal components of the drywall spray gun 100. The internal components are further described in FIG. 1B. The slide lock trigger 130 is disposed below the casing 120 and disperses the drywall material in the hopper 110 to a desired suitable location and area when depressed. The trigger shield 140 is also disposed below the casing 120 and protects the slide lock trigger 130 from being struck or touched unintentionally that may possibly disperse any unwanted drywall material. The rechargeable battery pack 150 is connected to the casing 120 by a handle 152 and provides electrical power to the drywall spray gun 100. The rechargeable battery pack 150 includes a pair of rechargeable batteries 154 housed within the rechargeable battery pack 150 and includes a plug-in charger unit 156. The pair of rechargeable batteries 154 can be replaced with a charged lithium battery 158 if desired. Any suitable battery type can be housed within the rechargeable battery pack 154 to provide electrical power to the drywall spray gun 100. The removable motor 160 also provides power to the drywall spray gun 100 to disperse drywall material. The removable motor 160 can be 3,000 rpms or any other suitable power. The forearm rest 170 is disposed on a rear portion 172 of the casing 120 and provides an area for a user to rest their forearms on while dispersing any drywall material. The adjustable nozzle 180 is disposed on a proximal end 182 of the casing 120 and includes a plurality of adjustable openings 184 to accommodate and dispense different drywall material.

Figure 1B:
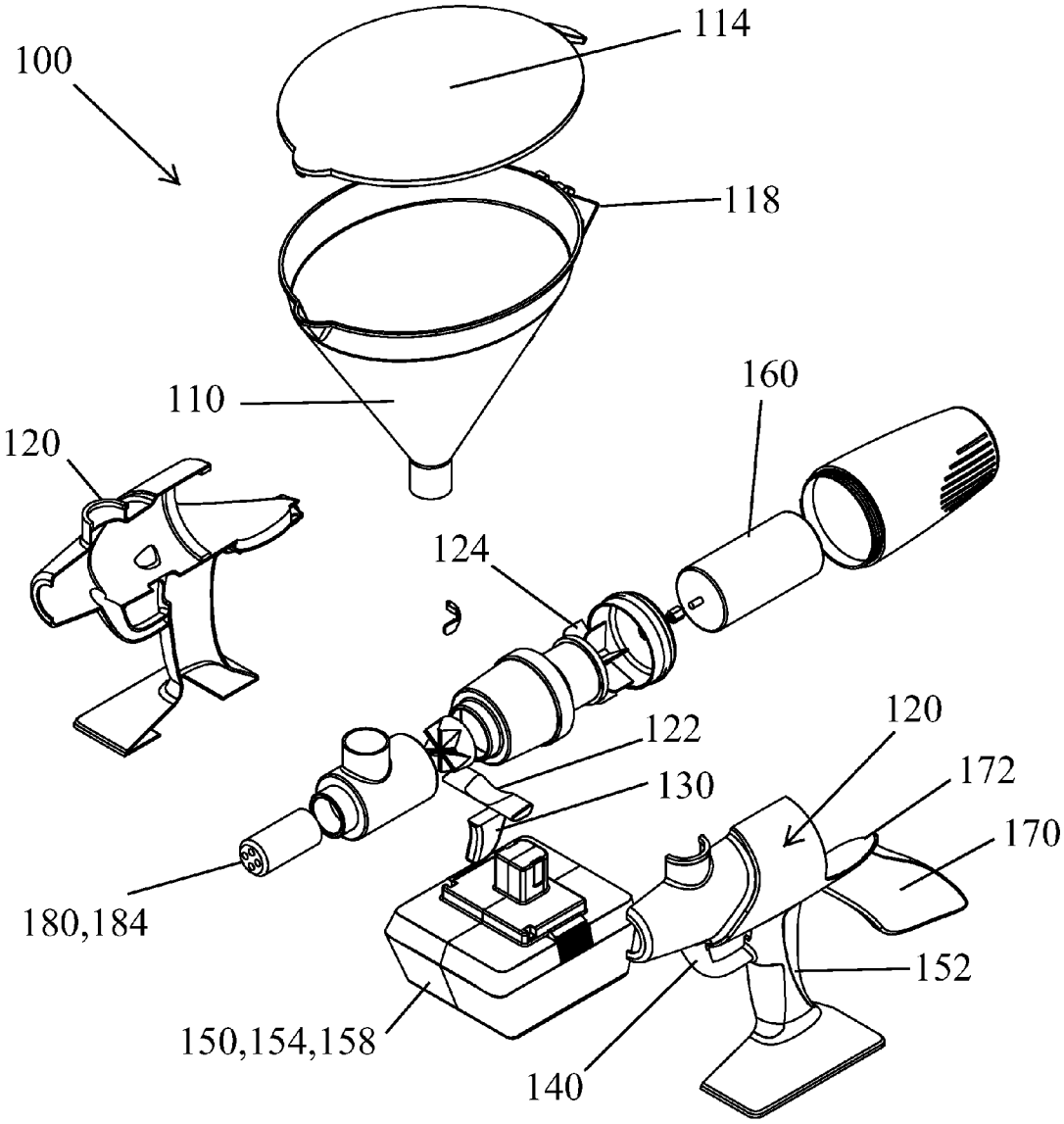
FIG. 1B illustrates an exploded diagonal side and front perspective view of a drywall spray gun, in accordance with one embodiment of the present invention.

FIG. 1B illustrates an exploded diagonal side and front perspective view of a drywall spray gun 100, in accordance with one embodiment of the present invention.

FIG. 1B includes the same components of the drywall spray gun 100 described in FIG. 1A. These components include the hopper 110, the casing 120, the slide lock trigger 130, the trigger shield 140, the rechargeable battery pack 150, the removable motor 160, the forearm rest 170 and the adjustable nozzle 180. The casing 120 includes a flip lever 122 and a fan 124. The flip lever 122 is in contact with the slide lock trigger 130 and when the slide lock trigger 130 is depressed. The flip lever 122 and the slide lock trigger 130 activate the drywall spray gun 100 to disperse drywall material that is contained in the hopper 110 when the slide lock trigger 130 is depressed. The fan 124 is housed within the casing 120 to cool the casing 120 and the dispersed drywall material as it moves through the casing 120.

Figure 1C:
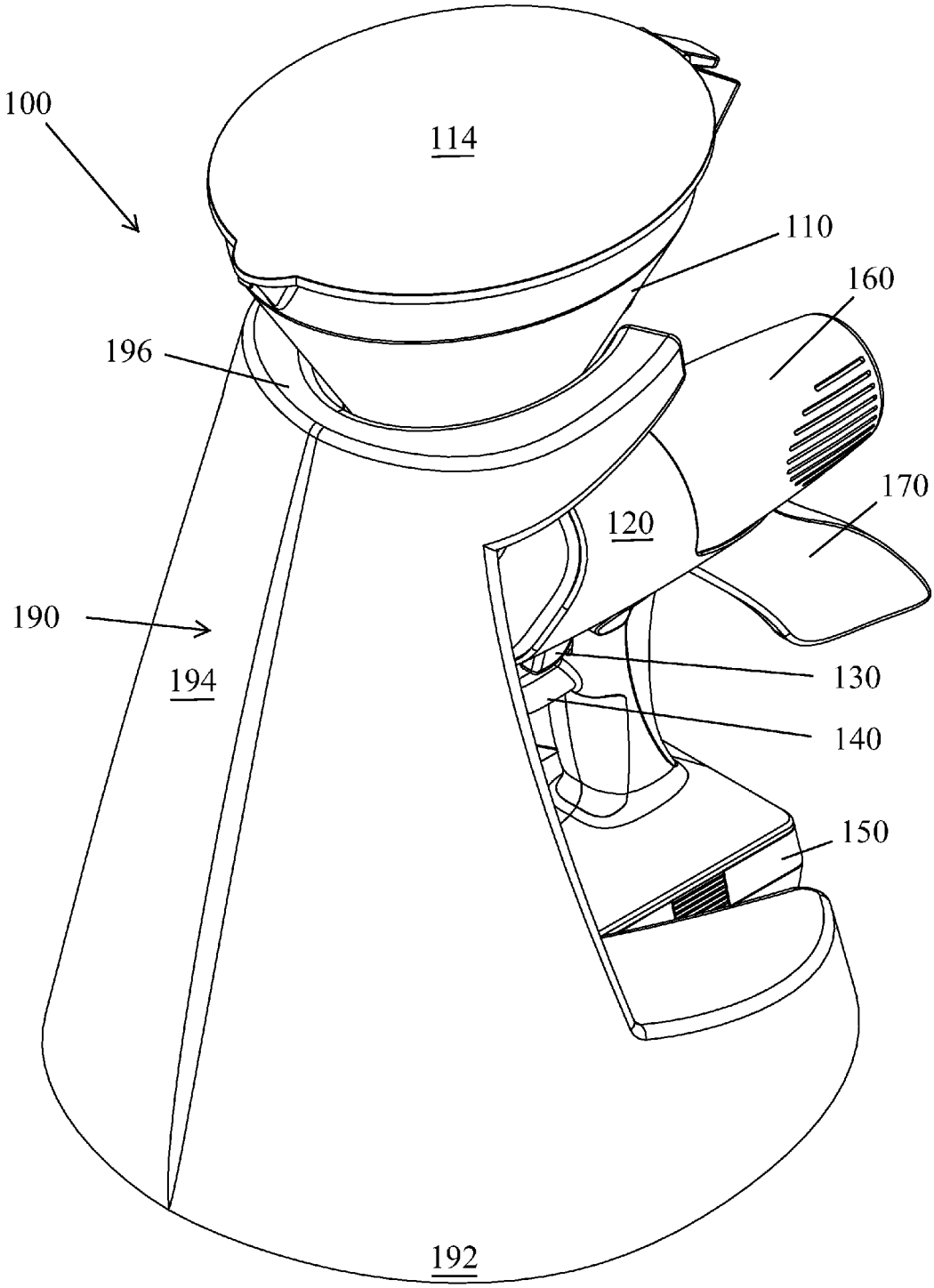
FIG. 1C illustrates a diagonal rear side perspective view of a drywall spray gun, in accordance with one embodiment of the present invention.

FIG. 1C illustrates a diagonal rear and side perspective view of a drywall spray gun 100, in accordance with one embodiment of the present invention.

FIG. 1C includes the same components of the drywall spray gun 100 described in FIG. 1A and FIG. 1B. These components include the hopper 110, the casing 120, the slide lock trigger 130, the trigger shield 140, the rechargeable battery pack 150, the removable motor 160, the forearm rest 170 and the adjustable nozzle 180. The drywall spray gun 100 includes a corresponding stand 190 that secures the drywall spray gun 100 in place while drywall material is poured into the hopper 120, as illustrated in FIG. 1C. The corresponding stand 190 includes a bottom base 192, an upright vertical backing 194 and a c-shaped top 196. The bottom base 192 is placed on a surface where drywall material is poured into the drywall spray gun 100. The upright vertical backing 194 receives and accommodates the drywall spray gun 100 as the drywall spray gun 100 is placed against the upright vertical backing 194. The c-shaped top 196 accommodates the hopper 120 of the drywall spray gun 100 and stabilizes the hopper 120 as drywall material is poured into the hopper 120.

Instead of using a conventional drywall texture hopper that requires a long plug-in power cable, the rechargeable drywall spray gun features a removable battery pack that provides power to the spray gun without needing a long, cumbersome cord, hose, or an air-compressor unit. It features a top funnel with a 2.0-gallon capacity, a secure lid lock, a slide-lock trigger and a plurality of adjustable openings to select the desired spray-texture. The spray gun also features a built-in motor (3,000 rpm for example) and an integrated fan. The spray gun could operate using a lithium battery pack, which can be easily swapped out for an extra fully recharged battery whenever needed. The spray gun also comes with a convenient stand that holds the spray gun upright when the funnel needs to be refilled with more drywall texture compound.

The rechargeable drywall spray gun is a suitable tool for a commercial or professional drywall contractor. Use of the spray gun includes ensuring the unit's lithium battery is fully charged, lifting the funnel lid, adding thinned drywall texture compound into the funnel, closing the lid of the funnel and locking the funnel. Adjust the texture-dispensing outlet to the most appropriate desired setting for a particular surface and activate the spray gun. When ready to use, depress the slide-lock trigger to spray drywall texture onto the desired surface. If a battery begins to lose power, turn off the spray gun, remove the battery and replace it with a fully charged lithium battery if desired. If the funnel needs to be refilled, insert the unit into its stand, which keeps it upright, and add more drywall material. When finished with the job, there are no cords, cables, or compressors to pack-up and transport.

The rechargeable spray gun includes the following benefits:

Saves time and money compared to conventional units. The user is likely to finish more jobs in a day.

Rechargeable battery-powered unit allows it to work in homes still under construction, even if the power hasn't been installed yet that prevents wasting time (and money) waiting for other contractors to complete their jobs.

Lightweight, easy to carry before, during and after a job. Eliminates having to pack cords, hoses or compressors with no need to 1 μg them around multiple rooms, or from one site to another.

No cumbersome, dangling cord means tangle-free operation and no wrapping around ladders, compressor units, or other equipment and accessories.

Adjustable openings allow the user to customize the texture size for a particular type of job and surface.

A forearm rest provides comfort, plus balanced distribution of weight during use. It also helps protect the forearm from coming in contact with the motor housing.

Integrated flip-lever allows the funnel to be easily removed. The motor can also be removed for cleaning, when needed.

The included stand conveniently holds the unit upright for quick, easy, mess-free refilling even by one person.

Utilizes rechargeable batteries and a plug-in charger unit. When needed, swap out the lithium battery for example, and insert a fully charged Li battery.

Applicable for professional contractors as well as the general consumer. Different versions could be created, allowing the user to choose the best fit for their particular needs (on large job sites vs. existing household touch-ups, etc.).

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A drywall spray gun that disperses drywall material, comprising:

a hopper that receives said drywall material to be dispersed by said spray gun;

a casing that houses a flip lever and a fan that cools said casing and said drywall material when moving through said casing;

a slide lock trigger that is disposed below said casing and disperses said drywall material in said hopper to a desired location when depressed;

a trigger shield that is disposed below said casing and protects said slide lock trigger from being struck or touched unintentionally;

a rechargeable battery pack that includes a pair of rechargeable batteries that is connected to said casing by a handle and provides electrical power to said drywall spray gun;

a removable motor that provides power to the drywall spray gun to disperse drywall material;

a forearm rest that is disposed on a rear portion of said casing and provides an area to be used by a user with a pair of forearms to rest said forearms on while dispersing said drywall material;

an adjustable nozzle that is disposed on a proximal end of said casing and includes a plurality of adjustable openings to accommodate and dispense a plurality of different said drywall material; and a corresponding stand with a bottom base, an upright vertical backing and a c-shaped top that secures said drywall spray gun in place while said drywall material is poured into said hopper.

2. The spray gun according to claim 1, wherein said hopper includes a lid lock.

3. The spray gun according to claim 1, wherein said hopper has a rounded pouring edge and a triangular-shaped pouring edge to pour said drywall material out of said hopper if needed.

4. The spray gun according to claim 1, wherein said hopper has a handle and an ergonomic tab to grasp and maneuver said hopper.

5. The spray according to claim 1, wherein said hopper is funnel-shaped.

6. The spray gun according to claim 1, wherein said flip lever is in contact with said slide lock trigger when said slide lock trigger is depressed to activate said drywall spray gun to disperse said drywall material that is contained in said hopper.

7. The spray gun according to claim 1, wherein said rechargeable battery pack includes a plug-in charger unit.

8. The spray gun according to claim 1, wherein said upright vertical backing receives and accommodates said drywall spray gun as said drywall spray gun is placed against said upright vertical backing.

9. The spray gun according to claim 1, wherein said c-shaped top accommodates and stabilizes said hopper of said drywall spray gun as said drywall material is poured into said hopper.

10. A drywall spray gun that disperses drywall material, comprising:

a funnel-shaped hopper with a top perimeter that receives said drywall material to be dispersed by said spray gun;

a casing that houses a flip lever and a fan that cools said casing and said drywall material when moving through said casing;

a slide lock trigger that is disposed below said casing and disperses said drywall material in said hopper to a desired location when depressed;

a trigger shield that is disposed below said casing and protects said slide lock trigger from being struck or touched unintentionally;

a rechargeable battery pack that includes a pair of rechargeable batteries that includes a plug-in charger unit that is connected to said casing by a handle and provides electrical power to said drywall spray gun;

a removable motor that provides power to the drywall spray gun to disperse drywall material;

a forearm rest that is disposed on a rear portion of said casing and provides an area to be used by a user with a pair of forearms to rest said forearms on while dispersing said drywall material;

an adjustable nozzle that is disposed on a proximal end of said casing and includes a plurality of adjustable openings to accommodate and dispense a plurality of different said drywall material; and a corresponding stand with a bottom base, an upright vertical backing and a c-shaped top that secures said drywall spray gun in place while said drywall material is poured into said hopper.

11. The spray gun according to claim 10, wherein said hopper includes a lid lock.

12. The spray gun according to claim 10, wherein said hopper has a rounded pouring edge and a triangular-shaped pouring edge to pour said drywall material out of said hopper if needed.

13. The spray gun according to claim 12, wherein said rounded pouring edge and said triangular-shaped pouring edge are positioned 180 degrees across from each other along said top perimeter of said hopper.

14. The spray gun according to claim 10, wherein said hopper has a handle and an ergonomic tab to grasp and maneuver said hopper.

15. The spray gun according to claim 10, wherein said hopper has a capacity of approximately 2.0 gallons.

16. The spray gun according to claim 10, wherein said flip lever is in contact with said slide lock trigger when said slide lock trigger is depressed to activate said drywall spray gun to disperse said drywall material that is contained in said hopper.

17. The spray gun according to claim 10, wherein said rechargeable batteries can be replaced with a charged lithium battery.

18. The spray gun according to claim 10, wherein said removable motor is an approximate 3,000 rpm removable motor.

19. The spray gun according to claim 10, wherein said upright vertical backing receives and accommodates said drywall spray gun as said drywall spray gun is placed against said upright vertical backing.

20. The spray gun according to claim 10, wherein said c-shaped top accommodates and stabilizes said hopper of said drywall spray gun as said drywall material is poured into said hopper.

* * * * *